US006933899B2

(12) United States Patent
Prassmayer et al.

(10) Patent No.: US 6,933,899 B2
(45) Date of Patent: Aug. 23, 2005

(54) MOTOR AND/OR TRANSMITTING DEVICE

(75) Inventors: Peter Karl Prassmayer, Grosskarolinenfeld (DE); Christian Magg, Garching (DE)

(73) Assignee: Kathrein Werke KG, Rosenheim (DE)

( * ) Notice: Subject to any disclaimer, the term of this patent is extended or adjusted under 35 U.S.C. 154(b) by 0 days.

(21) Appl. No.: 10/470,165

(22) PCT Filed: Feb. 20, 2003

(86) PCT No.: PCT/EP03/01751

§ 371 (c)(1),
(2), (4) Date: Oct. 3, 2003

(87) PCT Pub. No.: WO03/071630

PCT Pub. Date: Aug. 28, 2003

(65) Prior Publication Data

US 2004/0056809 A1 Mar. 25, 2004

(30) Foreign Application Priority Data

Feb. 22, 2002 (DE) ..... 102 07 703

(51) Int. Cl.[7] ..... H01Q 1/32
(52) U.S. Cl. ..... 343/713; 343/715; 343/745
(58) Field of Search ..... 343/704, 702, 343/711, 712, 713, 715, 745, 749

(56) References Cited

U.S. PATENT DOCUMENTS

| | | | | | |
|---|---|---|---|---|---|
| 4,764,773 | A | * | 8/1988 | Larsen et al. | 343/713 |
| 4,862,183 | A | * | 8/1989 | Blaese | 343/715 |
| 5,128,685 | A | | 7/1992 | Shinnai et al. | 343/713 |
| 5,343,214 | A | * | 8/1994 | Hadzoglou | 343/713 |
| 5,999,132 | A | | 12/1999 | Kitchener et al. | 343/702 |
| 6,191,747 | B1 | | 2/2001 | Cosenza | 343/749 |
| 6,259,411 | B1 | * | 7/2001 | Yanagisawa et al. | 343/713 |

FOREIGN PATENT DOCUMENTS

| | | |
|---|---|---|
| DE | 197 39 395 | 3/1999 |
| DE | 298 21 723 | 6/1999 |
| EP | 0 557 794 A1 | 2/1993 |
| EP | 0 862 239 A1 | 9/1998 |
| EP | 0 829 112 B1 | 10/1999 |
| EP | 0 954 054 A1 | 11/1999 |
| EP | 1 263 079 A1 | 12/2002 |
| EP | 1 291 967 A1 | 3/2003 |
| WO | 97/41621 | 11/1997 |
| WO | 98/10485 | 3/1998 |
| WO | 98/15031 | 4/1998 |
| WO | 98/48479 | 10/1998 |
| WO | 98/58422 | 12/1998 |
| WO | 99/43042 | 8/1999 |
| WO | 99/67851 | 12/1999 |
| WO | 01/71847 A1 | 9/2001 |
| WO | 02/069444 A1 | 9/2002 |

* cited by examiner

*Primary Examiner*—Tho Phan
(74) *Attorney, Agent, or Firm*—Nixon & Vanderhye P.C.

(57) ABSTRACT

A receiving and/or transmitting device for motor vehicles has an antenna foot, with a housing. An electrical connection for an antenna element, which is preferably in turn electrically connected to a further antenna element via a lock-out coil, is made via an internal connecting line. The connecting line is preferably in the form of a bracket, and/or the first antenna is provided with an electrically conductive extension.

16 Claims, 3 Drawing Sheets

MOTOR AND/OR TRANSMITTING DEVICE

CROSS-REFERENCES TO RELATED APPLICATIONS

This application is the U.S. national phase of international application PCT/EP03/01751 filed 20 Feb. 2003, which designated the U.S.

STATEMENT REGARDING FEDERALLY SPONSORED RESEARCH OR DEVELOPMENT

Not applicable.

FIELD

The technology herein relates to an antenna for a receiving and/or transmitting device, in particular as a roof antenna for motor vehicles.

BACKGROUND AND SUMMARY

By way of example, DE 197 39 395 A1 discloses a broadcast radio receivers, for installation in motor vehicles. This receiver has a receiving section with at least one connection, via which further components can be connected. An antenna in the form of a rod can be plugged in above the receiving section.

An antenna for automobiles is also disclosed, for example, in DE 298 21 723 U1. The antenna has an antenna foot which comprises a protective cover in the form of a housing or shroud, and a baseplate which can be mounted on the roof of the automobile. Various electrical devices are accommodated in the internal space between the shroud and the baseplate. A line 12 leads to the actual antenna element devices, which project outward from the foot part. What is referred to as a combination antenna element is used for this purpose, which is provided at its lower end with a threaded projection, in order to make it possible then to screw the threaded antenna element into and out of a threaded bushing in the foot part.

In this case, further devices can also be accommodated in the antenna foot, in order in the end to make it possible to receive different frequency bands via one or more radio-frequency lines. Specifically, antennas such as these should be suitable, for example, for various networks in the mobile radio band (for example the D network or E network, as well as for the UMTS frequency band from about 1 900 MHz to 2 170 MHz). Furthermore, if required, it should also be possible to receive and process GPS signals and/or to receive VHF broadcasts or programs.

The antennas available on the market at the moment have been proven in principle, although different implementation and conversion principles are known.

However, against the background of the last-mentioned antenna of this generic type, there is a problem, in that an antenna such as this with what is referred to as a combination antenna element is now also intended to be suitable for the UMTS Standard in addition to the normal mobile radio band in the DoCoMo band, in the AMPS band, and/or in the GSM 900 band i.e., in the 810 to 960 MHz band) and/or in the GSM 1 800 and/or in the GSM 1 900 band (i.e., in the 1 710 and 1 990 MHz band). This is because an antenna which is suitable for this overall range implies that, for the higher frequencies which can be transmitted, the antenna elements which are provided for this high frequency range must be designed to be smaller, that is to say shorter, and this also applies to the antenna bracket However, this would then lead to the antenna having to be modified overall, including the existing antenna element. However, this is contrary to what is referred to as the "identical parts" concept, on the basis of which, for example, one antenna element type should be used for different purposes.

A two-band antenna has been disclosed, for example, in the B1 version of U.S. Pat. No. 6,191,747. This is a multiband antenna using coils for phase shifting in order to form a monopole gain antenna element.

A two-band motor vehicle antenna which forms this generic type and has an antenna foot has been disclosed in WO 0 171 847 A1, in which a connecting line is connected to the antenna element arrangement via an intermediate line piece.

Against the background of the prior art of this generic type, the object of the exemplary illustrative non-limiting technology herein is therefore to provide an improved multiband antenna arrangement.

The technology herein provides an intrinsically highly proven motor vehicle antenna that can now also be used, for example, for the UMTS Standard or other considerably higher frequency band, and without any reduction to the physical height or physical size. In an exemplary illustrative implementation, this is possible because the electrical line which leads to an antenna element for the higher frequency range or a bracket which leads to the antenna element for the higher frequency range is provided with an extension. The extension can be implemented in such a way that the supply lines are lengthened beyond a connecting point or contact point via which the antenna element makes electrical contact with the supply line, and preferably ends freely. If the electrical supply line is formed by an electrically conductive bracket, then the bracket can be lengthened beyond the contact-making point with the first antenna element, with the contact-making point in this case at the same time being used as a connecting point or even as an attachment point for the antenna element. However, the extension need not necessarily be provided such that it runs continuously over the electrical wire or bracket, but may also be in the form of a line section that is passed back. It is also possible to use an extension which points downward via the connecting point between the electrical supply line or bracket and the electrical antenna element which is provided for the higher frequency range, and which possibly ends shortly before the motor vehicle roof.

Extensions which, for example, are in the form of a disk or of a plate are also suitable, and preferably are provided at the connecting point between the electrical supply line or bracket and the antenna element which is provided for the higher frequency range.

However, normally, not only is one antenna element used, preferably in the form of a bolt, which is provided for the higher frequency range, but a coil followed by a further antenna element is then used in the extension of this antenna element.

In the process, it should be remembered that the entire antenna element arrangement including the antenna bracket acts as an antenna element for the low frequency ranges, that is to say for long waves, medium waves, short waves and the VHF band. For the DoCoMo, the AMPS and the GSM 900 bands (which corresponds to 810 to 960 MHz), the antenna bracket and the lower part of the actual antenna clement arrangement, that is to say generally of the antenna clement bolt which is provided for his purpose, still act together with one part of the coil that has been mentioned as antenna elements. However, if the frequency is raised further, that is to say for example to the GSM 1 800 and GSM 1 900 bands (which correspond to 1 710 MHz to 1 990 MHz), only the antenna bracket and the lower antenna bolt then still act as antenna elements. However, only the antenna bracket and its extension then still act as antenna elements in the UMTS band (1 900 to 2 170 MHz).

BRIEF DESCRIPTION OF THE DRAWINGS

These and other features and advantages will be better and more completely understood by referring to the following detailed description of exemplary non-limiting illustrative implementations in conjunction with the drawings of which.

DETAILED DESCRIPTION

Figure 1:
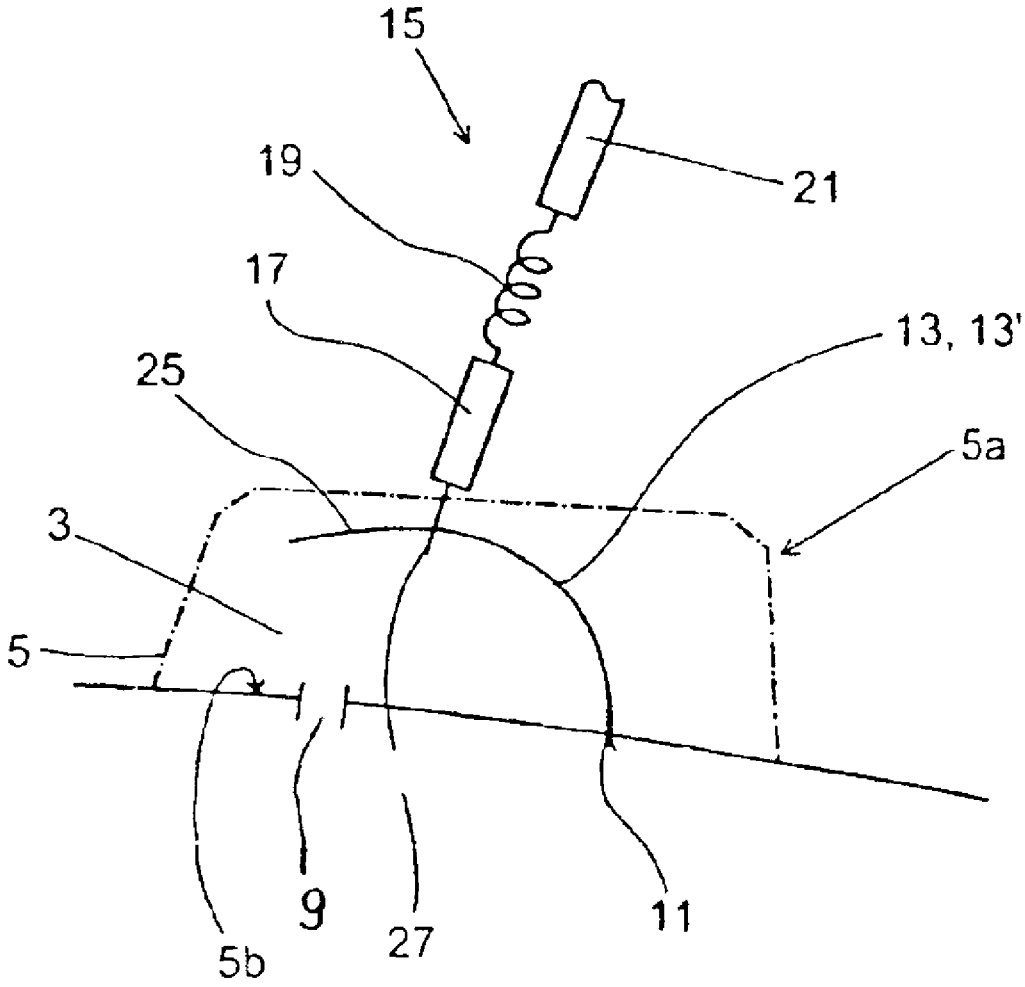
FIG. 1 shows a schematic side view of a first exemplary illustrative non-limiting implementation.

FIG. 1 shows a schematic side view in the form of a cross section of the contour of a metal bodywork sheet 1 of a motor vehicle, preferably in the roof area adjacent to the rear windshield, on which a corresponding antenna is intended to be mounted.

The transmitting and/or receiving device shown in FIG. 1 for this purpose has an antenna foot 3, which is in the form of a housing 5.

For this purpose, the housing 5 preferably has a protective cover 5*a* in the form of a shroud, and a bottom plate 5*b*, which can be attached by suitable measures to the metal bodywork sheet 1, for example using adhesive layers, insulating materials etc.

At least one opening 9 is also generally provided in the metal bodywork sheet 1, via which electrical connecting lines, coaxial cables etc. can be passed to the antenna from the interior of the motor vehicle. For this purpose, the bottom plate of the antenna housing is also fitted in an appropriate manner on the motor vehicle roof. For example a threaded dome in the form of a hollow threaded rod may normally be used (although this is not shown in any more detail in the drawings but has been known for a long time). The dome may be anchored in the bottom plate and projects into the interior of the motor vehicle through the opening 9 in the motor vehicle roof. The lines are then passed inward through the interior of the threaded dome. A central nut can then be screwed to the threaded dome from the interior of the vehicle, in order to anchor the antenna firmly on the motor vehicle roof in this way.

A connecting line 13 leads from an antenna point 11, which is provided in the antenna foot 3, to the actual antenna device 15 which, in the illustrated exemplary non-limiting arrangement, comprises a first antenna element 17, a lock-out coil 19 which is preferably arranged in an axial extension of the first antenna element 17, and a second antenna element 21 which is once again connected in an axial extension of the lock-out coil 19.

The first antenna element 17 may, for example, comprise a metallically conductive bolt or have a bolt structure. The second antenna element 21 should be as elastic as possible and may, for example, be formed from a glass fiber core around which a corresponding electrical conductive arrangement in the form of a coil is wound. All possible antenna structures are feasible which may be used and are suitable for the respective purpose.

In the exemplary illustrative non-limiting implementation, the entire antenna element arrangement including the antenna bracket acts as an antenna element for low frequency ranges, that is to say for long waves, medium waves, short waves and the VHF band. For the DoCoMo, the AMPS, and the GSM 900 band (which corresponds to 810 to 960 MHz), the antenna bracket and the lower part of the actual antenna element arrangement, that is to say generally of the antenna element bolt which is provided for this purpose, still act together with a part of the coil which has been mentioned as antenna elements. However, if the frequency is raised further, namely for example in the GSM 1 800 and GSM 1 900 band (which corresponds to 1 710 MHz to 1 990 MHz), only the antenna bracket and the lower antenna bolt still act as antenna elements. In the UMTS band (1 900 to 2 170 MHz), only the antenna bracket and its extension then still act as antenna elements.

For high frequency bands, for example in the E network (approximately 1 800 MHz) or in particular for the UMTS Standard (approximately 1 900 to 2 170 MHz) as well, the coil 19 provides blocking, so that only the first antenna element 17 together with the electrical connecting line 13 act as an antenna element for this purpose.

The connecting line 13 which has been mentioned may in this case preferably also be formed from an at least slightly elastic or partially elastic bracket 13', which is preferably prestressed in the antenna element direction. This means that the antenna bracket has a tendency to rest in a prestressed manner on the lower connecting point of the antenna element (in the interior of the housing) when the antenna element is installed, so that a permanent electrical contact can be provided here without any problems. The antenna element arrangement 15 can in this case normally be connected to the antenna housing 5 by means of a screw connection, so that the antenna, particularly when motor vehicles are passing through a car wash, can be unscrewed in advance without any problems, and can then be screwed on again. The actual antenna element arrangement 15 which can be screwed to the housing is, in the end, held and supported via the housing itself.

In order now to make it possible to use this antenna arrangement for the high frequency band ranges as well, matched to the high frequency band range, the first antenna element, preferably in the form of a bolt 17, and also the electrical connecting line 13 could be appropriately reduced in size.

However, since this is contrary to the identical parts concept, on the basis of which, for example, an already existing antenna clement arrangement which is also used for other purposes should also be used in the present case, this means that there is a need to look for other solutions.

Figure 2:
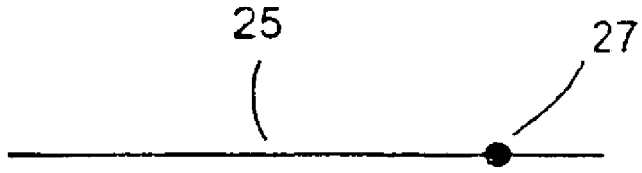
FIG. 2 shows a schematic plan view of the extended bracket in the exemplary illustrative non-limiting implementation shown in FIG. 1.

According to an exemplary illustrative non-limiting arrangement, an extension 25 is provided for this purpose in the exemplary non-limiting arrangement as shown in FIGS. 1 and 2. In this exemplary non-limiting implementation, this extension 25 is in the form of an extension to the connecting line 13 and thus, preferably, an extension to the bracket 13'. Extension 25 preferably passes beyond the connecting, attachment and/or contact-making point 27 on which the antenna element 17 which is provided for the higher frequency range. Thus, the entire antenna element arrangement is therefore attached and held, possibly via a bridging section on the electrical connecting line 13 or on the bracket 13'.

The length and width of the extension 25 must be designed such that the antenna is correctly tuned overall for the desired higher frequency range. This tuning can be carried out in various ways, as described in the following text.

FIG. 2 shows an extract of the extension 25, in the form of a schematic plan view, in its region which is lengthened beyond the connecting and/or attachment point and/or contact-making point 27. This shows that this extension may in principle be in the form of a wire, even if it is in the form of a rather stiffer, dimensionally stable and possibly elastic bracket 13'.

Figure 3:
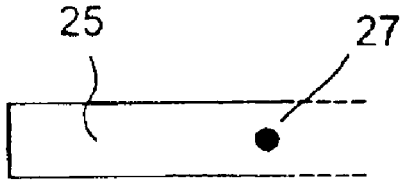
FIG. 3 shows a plan view, corresponding to that in FIG. 2, relating to an extension of the bracket which is designed to be shorter but broader for this purpose.

Apart from an extension according to the exemplary illustrative non-limiting implementation shown in FIGS. 1 and 2, the extension 25 may also be designed to be shorter if—as can be seen in particular from the plan view in FIG. 3—it is in contrast designed to be broader than in the exemplary illustrative non-limiting implementation shown in FIGS. 1 and 2.

Figure 4:
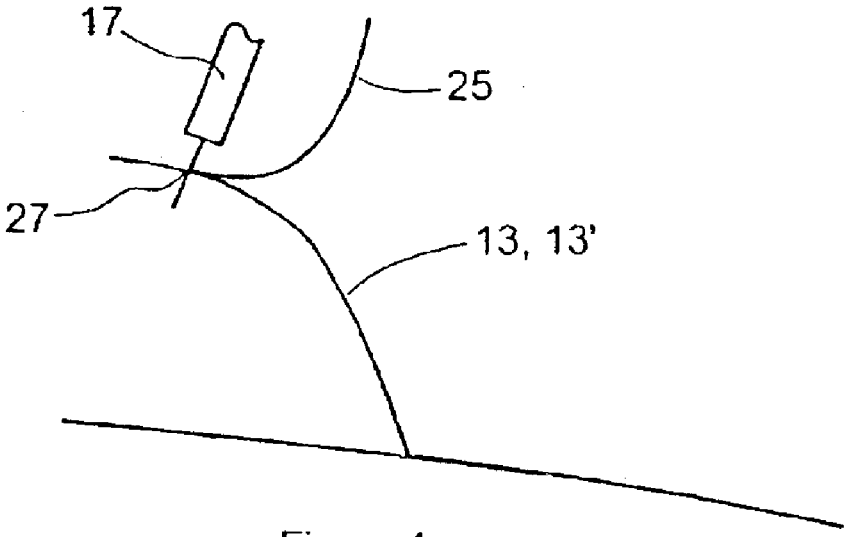
FIG. 4 shows an exemplary illustrative non-limiting implementation modified from that shown in FIGS. 1 and 2.

In the exemplary illustrative non-limiting implementation shown in FIG. 4, the extension 25 is effectively provided as a separate component with a curved shape, preferably originating from the connecting or attachment point 27, with its free end running increasingly more parallel to the antenna element 17. The length and width of this extension 25 may likewise once again be chosen to be different, in order to carry out the desired tuning for the respectively desired higher frequency band. The exemplary illustrative non-limiting implementations shown in FIGS. 1 to 4 have the common feature that the extension 25 ends freely, from the electrical point of view.

Figure 5:
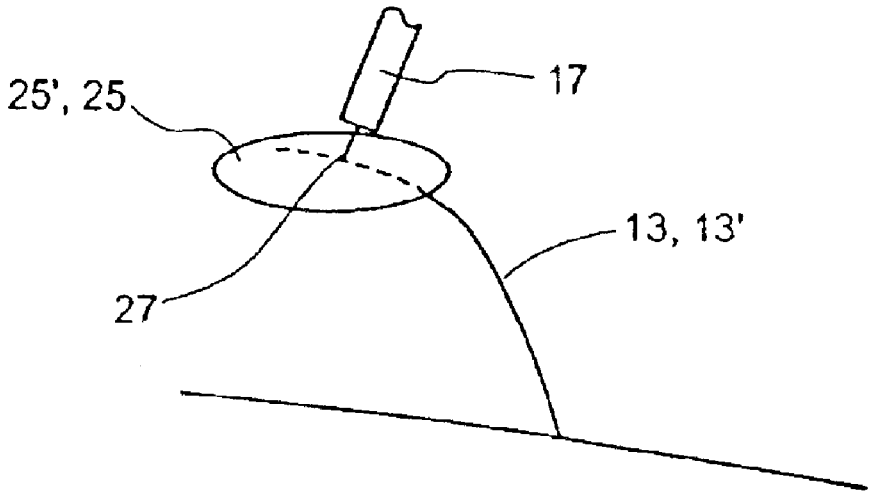
FIG. 5 shows a further modified exemplary illustrative non-limiting implementation, in the form of a schematic side view.

In the exemplary illustrative non-limiting implementation shown in FIG. 5, the extension 25 is shown in a virtually "degenerate" form. Specifically, the extension 25 is now in the form of a disk or a plate 25'. This disk or this plate 25' can thus now be continued not only in one direction away from the connecting line 13, (i.e., from the bracket 13'), but may effectively be in the form of a flat component in the circumferential direction.

Figure 6:
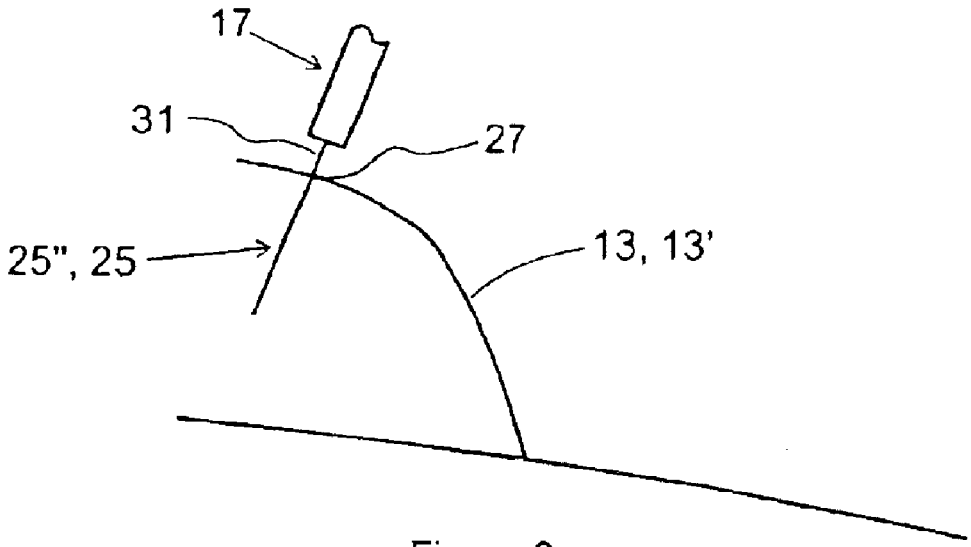
FIG. 6 shows a further modified exemplary illustrative non-limiting implementation.

FIG. 6 also shows that the extension 25 may be regarded and/or designed effectively as an extension 25 with respect to the first antenna element 17, as well. Specifically, according to this exemplary illustrative non-limiting implementation, the extension 25 is in the form of an axial extension 25" to the first antenna element 17, which is preferably in the form of a bolt, effectively as an extension to a short electrically conductive bridging piece, which provides an electrical connection from the connecting point 27 of the connecting line 13 to the first antenna element 17.

While the technology herein has been described in connection with exemplary illustrative non-limiting implementations, the invention is not to be limited by the disclosure. The invention is intended to be defined by the claims and to cover all corresponding and equivalent arrangements whether or not specifically disclosed herein.

What is claimed is:

1. An antenna for a mobile receiving and/or transmitting device comprising:

an antenna foot, a connecting line which is provided in the antenna foot for electrical connection of a first antenna element arrangement, the first antenna element arrangement comprising; at least one first antenna element, a further antenna element arrangement, and a lock-out coil that connects the further antenna element arrangement to the first antenna element arrangement, the lock-out coil and the first and second antenna element arrangements acting as a common antenna element arrangement at low frequencies, the lock-out coil substantially not passing higher frequencies, the connecting line including an electrically conductive extension, provided in the region of the antenna foot, the extension comprising a branch of an electrical connection formed by the connecting line and the first antenna element arrangement.

2. The antenna as claimed in claim 1, further including an antenna foot housing that accommodates the extension.

3. The antenna as claimed in claim 1, wherein the extension is in the form of a direct branching extension of the connecting line, with the connecting line being lengthened beyond a connecting attachment, and the connecting attachment representing an electrical connection for the first antenna element arrangement.

4. The antenna as claimed in claim 1, wherein the extension is in the form of a separate component.

5. The antenna as claimed in claim 4, wherein the extensions is in the form of an arc, and comprises free ends increasingly laterally offset approximately parallel to the axial longitudinal extent of the first antenna element arrangement.

6. The antenna as claimed in claim 4, wherein the extension is in the form of an extension to the connecting line, in the form of a bracket, forming a kink point.

7. The antenna as claimed in claim 1, wherein the extension is located on the same side with respect to the first antenna element arrangement as the connecting line.

8. The antenna as claimed in claim 1, wherein the extension and the connecting line are arranged opposite the first antenna element arrangement.

9. The antenna as claimed in claim 1, wherein the extension comprises a flat element, in the form of a disk or plate.

10. The antenna as claimed in claim 1, wherein the extension extends the first antenna element arrangement in the direction of the antenna foot.

11. The antenna as claimed in claim 1, wherein the extension comprises a wire, rod or plate.

12. The antenna as claimed in claim 1, wherein the extension is shorter and broader than an extension in the form of a wire, rod or plate.

13. The antenna as claimed in claim 1, wherein the connecting line comprises a bracket.

14. The antenna as claimed in claim 13, wherein the extension together with the connecting line forms a common bracket.

15. The antenna as claimed in claim 1 wherein, a bridging piece leads to the first antenna element arrangement.

16. A multiband RF antenna comprising:

a mounting bracket;

a connecting line;

a first antenna element arrangement coupled to said connecting line and mounted on said mounting bracket;

a frequency selective impedance element;

a second antenna element arrangement coupled to the frequency selective impedance element, said frequency selective impedance element selectively coupling RF between said first and second antenna element arrangements, the first and second antenna elements acting as a substantially unified radiator at lower frequencies and said first antenna element arrangement but not said second antenna element arrangement radiating at higher frequencies; and an electrically conductive extension of said mounting bracket comprising a branch of said connecting line, said extension allowing said antenna to operate at still higher frequencies.

* * * * *